US010851658B2

(12) United States Patent
Hafner

(10) Patent No.: US 10,851,658 B2
(45) Date of Patent: Dec. 1, 2020

(54) NOZZLE ASSEMBLY AND METHOD FOR FORMING NOZZLE ASSEMBLY

(71) Applicant: GENERAL ELECTRIC COMPANY, Schenectady, NY (US)

(72) Inventor: Matthew Troy Hafner, Honea Path, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 644 days.

(21) Appl. No.: 15/425,545

(22) Filed: Feb. 6, 2017

(65) Prior Publication Data

US 2018/0223680 A1 Aug. 9, 2018

(51) Int. Cl.

| | |
|---|---|
| ***F01D 9/04*** | (2006.01) |
| ***F01D 25/00*** | (2006.01) |
| *F01D 5/28* | (2006.01) |

(52) U.S. Cl.

CPC ..... *F01D 9/041* (2013.01); *F01D 9/042* (2013.01); *F01D 9/044* (2013.01); *F01D 25/005* (2013.01); *F01D 5/282* (2013.01); *F01D 5/284* (2013.01); *F05D 2220/32* (2013.01); *F05D 2230/232* (2013.01); *F05D 2240/128* (2013.01); *F05D 2250/121* (2013.01); *F05D 2250/141* (2013.01); *F05D 2250/60* (2013.01); *F05D 2300/17* (2013.01); *F05D 2300/174* (2013.01); *F05D 2300/175* (2013.01); *F05D 2300/604* (2013.01); *F05D 2300/6033* (2013.01)

(58) Field of Classification Search

CPC ..... F01D 9/042; F01D 9/044; F01D 25/005; F01D 5/282; F01D 5/284; F01D 9/041–044; F05D 2300/604; F05D 2300/17; F05D 2220/32; F05D 2230/232; F05D 2240/128; F05D 2250/121; F05D 2250/141; F05D 2250/60; F05D 2300/174; F05D 2300/175; F05D 2300/6033

USPC ..... 415/200

See application file for complete search history.

(56) References Cited

U.S. PATENT DOCUMENTS 2,942,844 A * 6/1960 Neate ..... F01D 25/246 415/137

3,071,346 A * 1/1963 Broffitt ..... F01D 9/042 415/137

(Continued)

*Primary Examiner* — Charles G Freay
*Assistant Examiner* — Thomas Fink
(74) *Attorney, Agent, or Firm* — McNees Wallace & Nurick LLC

(57) ABSTRACT

A nozzle assembly is disclosed, including a CMC nozzle shell, a nozzle spar, and an endwall. The CMC nozzle shell includes a CMC composition and an interior cavity. The nozzle spar is partially disposed within the interior cavity and includes a metallic composition, a cross-sectional conformation, a plurality of spacers protruding from the cross-sectional conformation, the plurality of spacers contacting the CMC nozzle shell, and a spar cap. The endwall includes at least one surface in lateral contact with the spar cap and maintains a lateral orientation of the CMC nozzle shell and the nozzle spar relative to the endwall. The lateral orientation maintains a predetermined throat area of the nozzle assembly. A method for forming the nozzle assembly includes inserting the nozzle spar into the interior cavity, rotating the CMC nozzle shell and the nozzle spar laterally relative to the endwall, and maintaining the lateral orientation.

11 Claims, 5 Drawing Sheets

(56) References Cited

U.S. PATENT DOCUMENTS

| | | | | |
|---|---|---|---|---|
| 5,332,360 | A * | 7/1994 | Correia | F01D 9/042 29/889.21 |
| 5,797,725 | A * | 8/1998 | Rhodes | B23P 6/005 415/209.2 |
| 6,648,597 | B1 * | 11/2003 | Widrig | C04B 37/001 415/200 |
| 7,326,030 | B2 | 2/2008 | Albrecht et al. | |
| 7,452,189 | B2 | 11/2008 | Shi et al. | |
| 8,251,652 | B2 | 8/2012 | Campbell et al. | |
| 8,292,580 | B2 | 10/2012 | Schiavo et al. | |
| 2005/0169759 | A1 * | 8/2005 | Haubert | F01D 9/044 416/193 R |
| 2009/0232644 | A1 * | 9/2009 | Greene | F01D 5/147 415/177 |
| 2011/0027098 | A1 * | 2/2011 | Noe | C04B 35/573 416/241 B |
| 2011/0171018 | A1 * | 7/2011 | Garcia-Crespo | F01D 9/042 415/208.2 |
| 2014/0161623 | A1 | 6/2014 | Zurmehly et al. | |
| 2015/0016972 | A1 * | 1/2015 | Freeman | F01D 9/02 415/175 |
| 2016/0123165 | A1 * | 5/2016 | McCaffrey | F01D 9/02 415/1 |
| 2016/0230576 | A1 * | 8/2016 | Freeman | F04D 29/023 |
| 2017/0022829 | A1 * | 1/2017 | Freeman | F01D 9/041 |
| 2017/0254207 | A1 * | 9/2017 | Schetzel | F01D 5/225 |
| 2019/0368363 | A1 * | 12/2019 | Walston | F01D 25/005 |
| 2020/0200023 | A1 * | 6/2020 | Whittle | F01D 9/041 |

* cited by examiner

NOZZLE ASSEMBLY AND METHOD FOR FORMING NOZZLE ASSEMBLY

STATEMENT REGARDING FEDERALLY SPONSORED RESEARCH

This invention was made with Government support under contract number DE-FE0024006 awarded by the Department of Energy. The Government has certain rights in the invention.

FIELD OF THE INVENTION

The present invention is directed to nozzle assemblies and methods for forming nozzle assemblies. More particularly, the present invention is directed to nozzle assemblies and methods for forming nozzle assemblies maintaining lateral orientations for maintaining predetermined throat areas.

BACKGROUND OF THE INVENTION

Gas turbines are continuously being modified to provide increased efficiency and performance. These modifications include the ability to operate at higher temperatures and under harsher conditions, which often requires material modifications and/or coatings to protect components from such temperatures and conditions. As more modifications are introduced, additional challenges are realized.

One modification to increase performance and efficiency involves forming gas turbine components, such as nozzles, at least partially from ceramic matrix composites ("CMC"). However, manufacturing tolerances for components formed with CMC may be larger than manufacturing tolerances for components formed by alternative methods, such as investment casting. Increased manufacturing tolerances may decrease aerodynamic efficiency and increase the occurrence of damaging pulses due to deviation of throat area from a preferred configuration for aerodynamic considerations and also due to variability in throat area about the gas turbine. Further, variability in each CMC component may preclude a generalized adjustment from being applied uniformly to all affected CMC components.

BRIEF DESCRIPTION OF THE INVENTION

In an exemplary embodiment, a nozzle assembly includes a CMC nozzle shell, a nozzle spar, and an endwall. The nozzle shell includes a CMC composition and an interior cavity having interior dimensions. The nozzle spar is partially disposed within the interior cavity, and includes a metallic composition, a cross-sectional conformation including cross-sectional dimensions less than the interior dimensions, a plurality of spacers protruding from the cross-sectional conformation, the plurality of spacers contacting the CMC nozzle shell, and a spar cap. The endwall includes at least one surface in lateral contact with the spar cap, and maintains a lateral orientation of the CMC nozzle shell and the nozzle spar relative to the endwall. The lateral orientation maintains a predetermined throat area of the nozzle assembly.

In another exemplary embodiment, a method for forming a nozzle assembly includes inserting a nozzle spar into an interior cavity of a ceramic matrix composite (CMC) nozzle shell, rotating the CMC nozzle shell and the nozzle spar laterally relative to an endwall to a lateral orientation setting a predetermined throat area of the nozzle assembly, and maintaining the lateral orientation. The CMC nozzle shell includes a CMC composition and the interior cavity having interior dimensions. The nozzle spar includes a metallic composition, a cross-sectional conformation including cross-sectional dimensions less than the interior dimensions, a plurality of spacers protruding from the cross-sectional conformation, a spar cap, and the endwall. The endwall includes at least one surface. Inserting the nozzle spar into the interior cavity places the plurality of spacers into contact with the CMC nozzle shell. Maintaining the lateral orientation includes placing the at least one surface in lateral contact with the spar cap.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are exemplary nozzle assemblies and methods for forming nozzle assemblies. Embodiments of the present disclosure, in comparison to articles and methods not utilizing one or more features disclosed herein, decrease costs, increase turbine efficiency, increase aerodynamic efficiency, increase process efficiency, increase part life, decrease downstream pulses, facilitate east of assembly, provide for more uniform downstream pulses, or a combination thereof.

Figure 1:
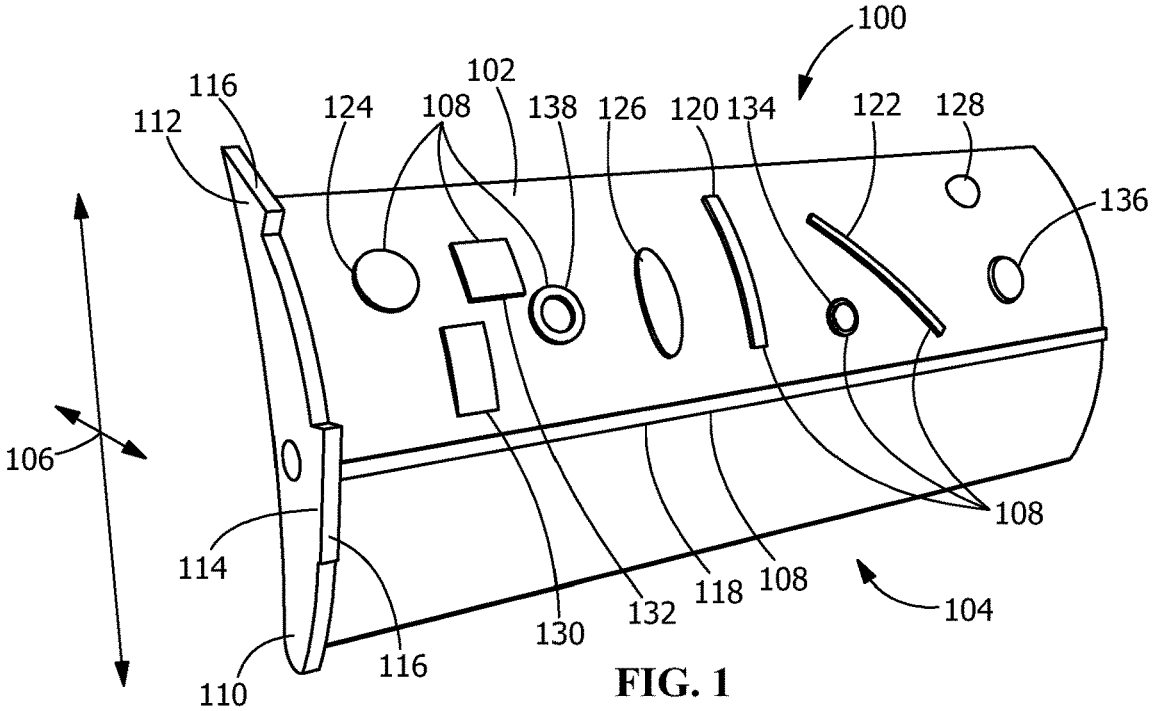
FIG. 1 is a perspective view of a nozzle spar, according to an embodiment of the present disclosure.

Referring to FIG. 1, in one embodiment, a nozzle spar 100 includes a metallic composition 102, a cross-sectional conformation 104 having cross-sectional dimensions 106, a plurality of spacers 108 protruding from the cross-sectional conformation 104, and a spar cap 110. The spar cap 110 may include a first alignment feature 112 and a second alignment feature 114, wherein the first alignment feature 112 and the second alignment feature 114 include a conformation suitable for establishing a relative alignment with another object. In one embodiment (shown), the first alignment feature 112 and the second alignment feature 114 are projections which may have flat surfaces 116, alternatively interlocking surfaces such as a saw tooth conformation (not shown). In another embodiment (not shown), at least one of the first alignment feature 112 and the second alignment feature 114 is an indentation.

The metallic composition 102 may include any suitable material, including, but not limited to, titanium-aluminum alloys, superalloys, nickel-based superalloys, cobalt-based superalloys, iron-based superalloys, refractory alloys, or combinations thereof.

The plurality of spacers 108 may include any suitable conformation, including, but not limited to, vertical ribs 118, horizontal ribs 120, diagonal ribs 122, circular protrusions 124, elliptical protrusions 126, semispheroidal protrusions 128, rectangular protrusions 130, square protrusions 132, crowned protrusions 134, frustoconical protrusions 136, annular protrusions 138, or combinations thereof.

Figure 2:
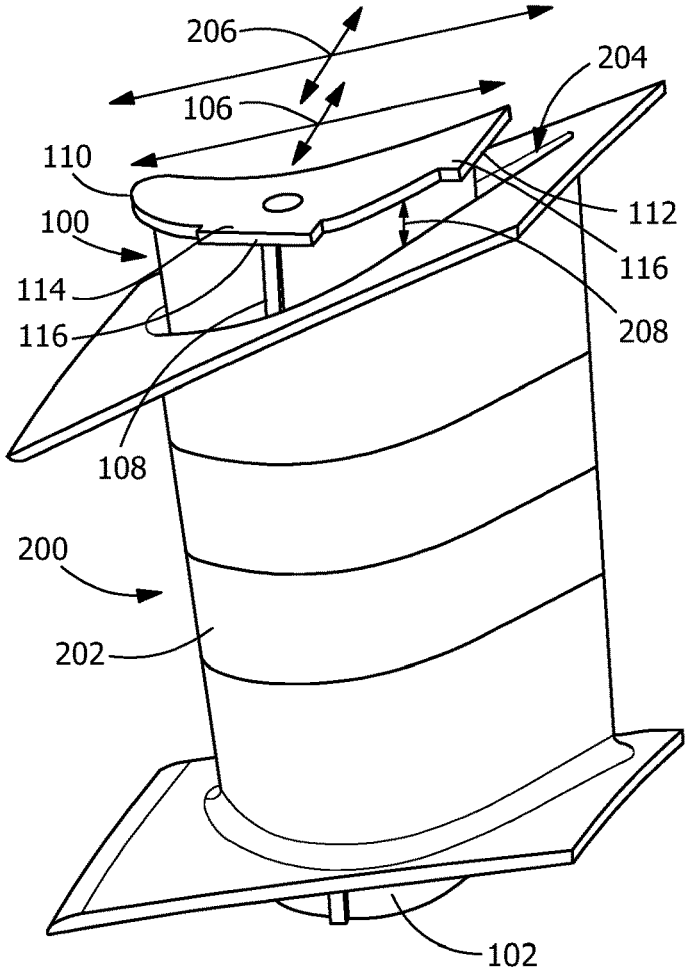
FIG. 2 is a perspective view of the nozzle spar of FIG. 1 inserted into a CMC nozzle shell, according to an embodiment of the present disclosure.

Referring to FIG. 2, in one embodiment, the nozzle spar 100 is partially disposed within an interior cavity 204 of a CMC nozzle shell 200. The CMC nozzle shell 200 includes a CMC composition 202 and the interior cavity 204 having interior dimensions 206. The cross-sectional dimensions 106 of the nozzle spar 100 are less than the interior dimensions 206. The plurality of spacers 108 contact the CMC nozzle shell 200.

The CMC composition 202 may be any suitable CMC composition, including, but not limited to, aluminum oxide-fiber-reinforced aluminum oxides (Ox/Ox), carbon-fiber-reinforced carbond (C/C), carbon-fiber-reinforced silicon carbides (C/SiC), silicon-carbide-fiber-reinforced silicon carbides (SiC/SiC), carbon-fiber-reinforced silicon nitrides ($C/Si_3N_4$), and combinations thereof.

Figure 3:
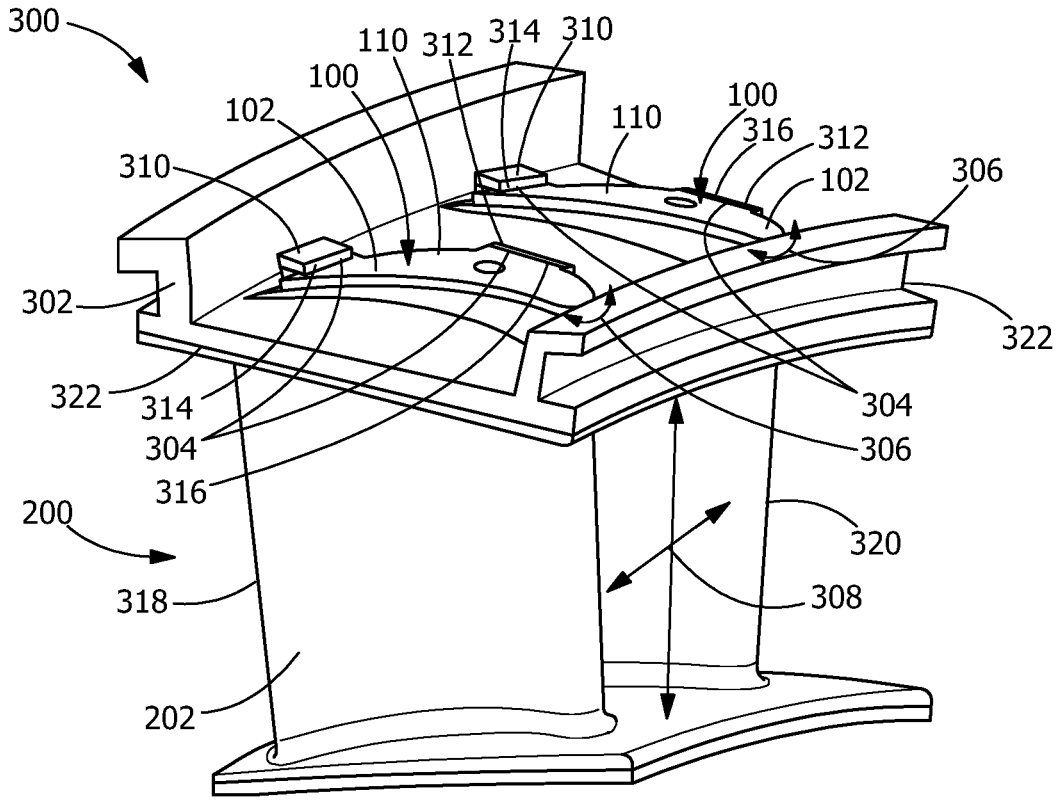
FIG. 3 is a perspective view of a nozzle assembly, according to an embodiment of the present disclosure.

Referring to FIG. 3, in one embodiment, a nozzle assembly 300 includes the nozzle spar 100 partially disposed within the interior cavity 204 of the CMC nozzle shell 200, and an endwall 302. The endwall 302 includes at least one surface 304 in lateral contact with the spar cap 110, the endwall 302 maintaining a lateral orientation 306 of the CMC nozzle shell 200 and the nozzle spar 100 relative to the endwall 302, the lateral orientation 306 maintaining a predetermined throat area 308 of the nozzle assembly 300. The endwall 302 may be an outer diameter endwall (shown), an inner diameter endwall, or a combination thereof.

The plurality of spacers 108 may be distributed to accommodate differential thermal growth of the CMC nozzle shell 200 and the nozzle spar 100 during operation of the nozzle assembly 300 without binding between the CMC nozzle shell 200 and the nozzle spar 100.

Figure 4:
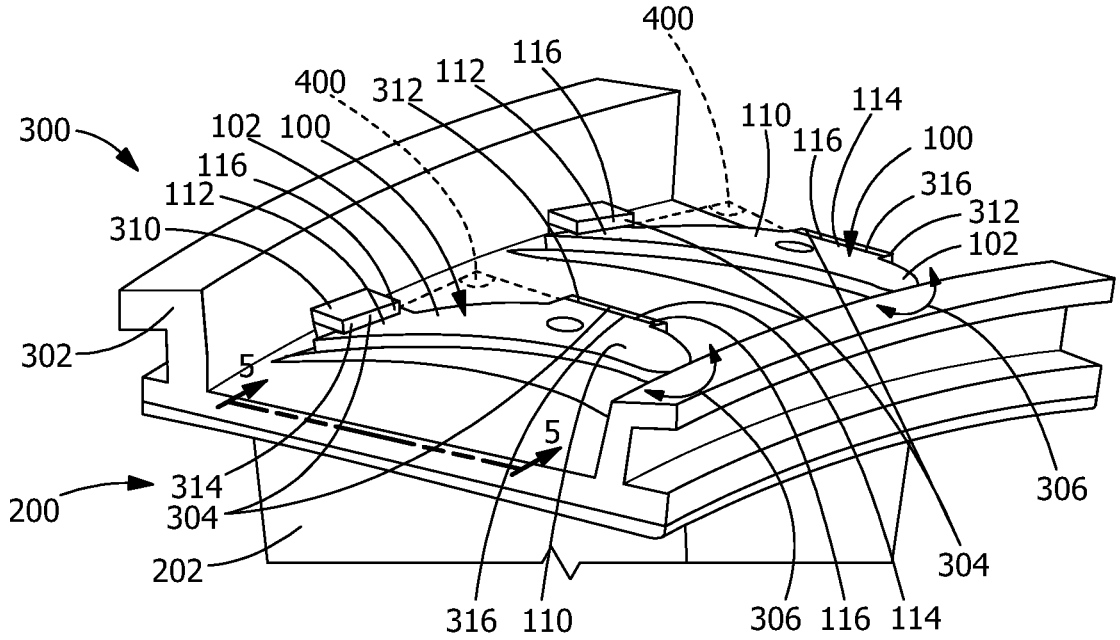
FIG. 4 is an expanded view of an endwall and spar cap of the nozzle assembly of FIG. 3 with alignment features of the spar cap contacting stanchions of the endwall, according to an embodiment of the present disclosure.

Referring to FIGS. 3 and 4, in one embodiment, the endwall 302 includes a first stanchion 310 and a second stanchion 312 extending from the endwall 302, the at least one surface 304 in lateral contact with the spar cap 110 including a first surface 314 of the first stanchion 310 in lateral contact with the spar cap 110 and a second surface 316 of the second stanchion 312 in lateral contact with the spar cap 110. The first surface 314 and the second surface 316 may be oriented relative to one another by any suitable angle 400, including, but not limited to, an angle 400 of about 60° to about 120°, alternatively about 70° to about 110°, alternatively about 80° to about 100°, alternatively about 85° to about 95°, alternatively about 90°.

In one embodiment, the first surface 314 of the first stanchion 310 is in lateral contact with a first alignment feature 112 of the spar cap 110 and the second surface 316 of the second stanchion 312 is in lateral contact with a second alignment feature 114 of the spar cap 110. The interaction of the first alignment feature 112 with the first surface 314 and the second alignment feature 114 with the second surface 316 may maintain the lateral orientation 306 of the CMC nozzle shell 200 and the nozzle spar 100 relative to the endwall 302.

Figure 5:
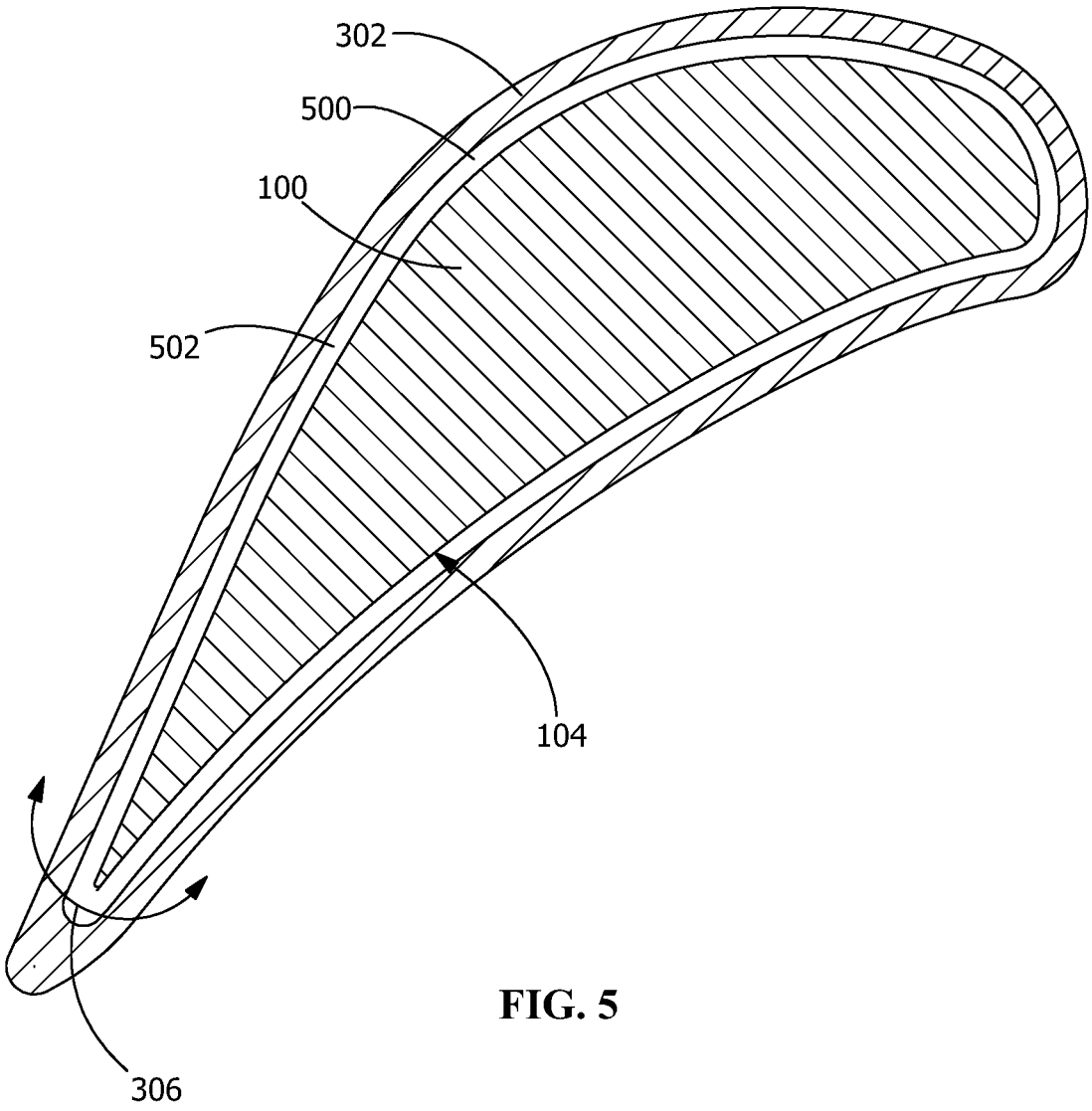
FIG. 5 is a sectional view along lines 5-5 of FIG. 4, according to an embodiment of the present disclosure.

Referring to FIG. 5, in one embodiment, the endwall 302 includes at least one aperture 500 and the nozzle spar 100 is partially disposed within the at least one aperture 500, the aperture 500 being larger than the cross-sectional conformation 104 of the nozzle spar within the aperture 500 and defining a gap 502 surrounding the nozzle spar 100 within the aperture 500. The gap 502 includes sufficient size for the nozzle spar 100 to rotate laterally (in the plane of the sectional view of FIG. 5) within the aperture 500 except for the presence of the at least one surface 304 in lateral contact with the spar cap 110 (see FIG. 4) maintaining the lateral orientation 306. The gap 502 may include any suitable size, including, but not limited to, a size sufficient for the nozzle spar 100 to rotate through a 10° arc within the aperture 500, alternatively a 7.5° arc, alternatively a 5° arc, alternatively a 3° arc, alternatively a 1° arc. The gap 502 may be de minimus in certain local areas. The gap 502 may be sealed to provide for separate cooling flows in the nozzle assembly 300.

Figure 6:
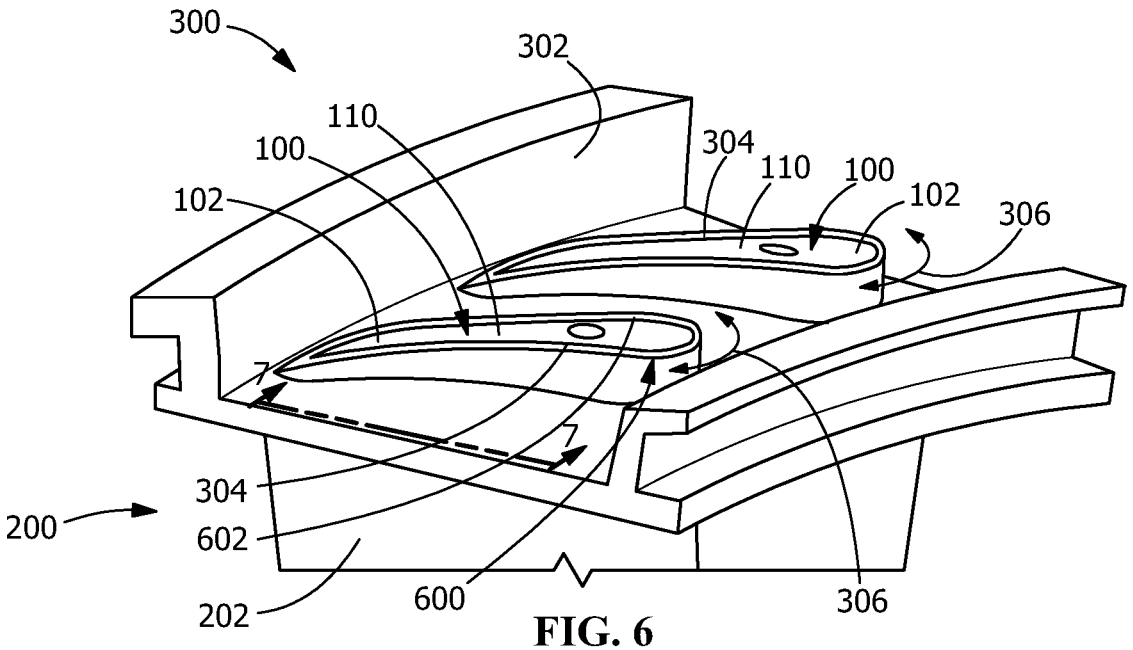
FIG. 6 is an expanded view of an endwall and spar cap of the nozzle assembly of FIG. 3 with the spar cap partially disposed within a depression of the endwall, according to an embodiment of the present disclosure.
Figure 7:
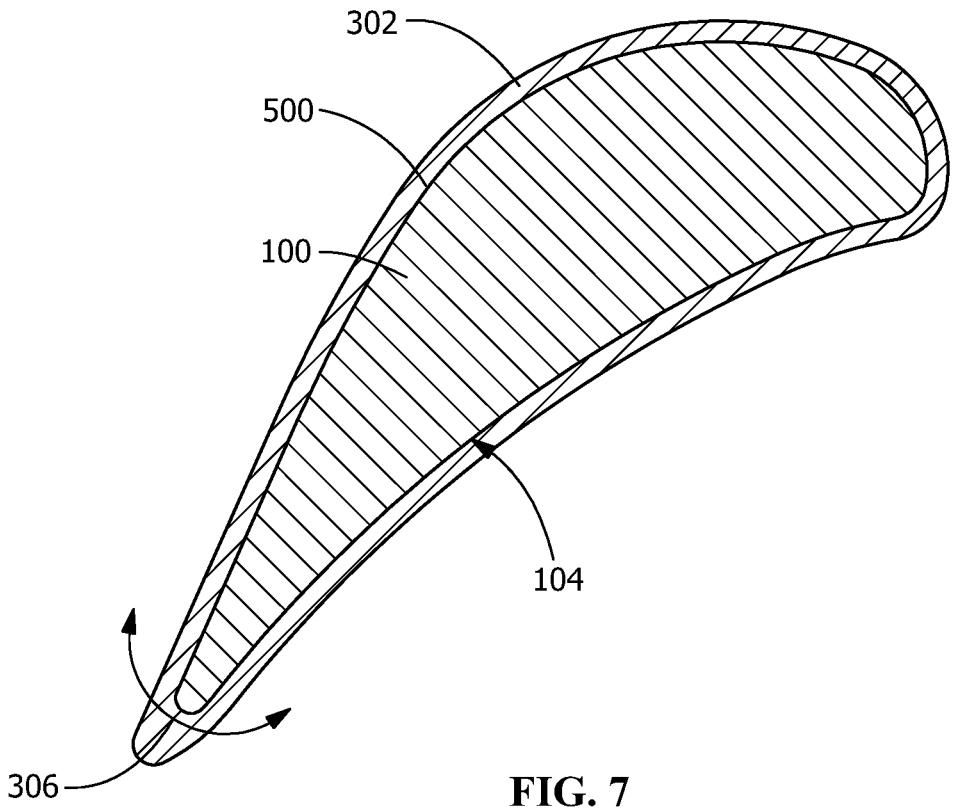
FIG. 7 is a sectional view along lines 7-7 of FIG. 6, according to an embodiment of the present disclosure.

Referring to FIGS. 6 and 7, in one embodiment, the endwall 302 includes at least one aperture 500 and the nozzle spar 100 is partially disposed within the at least one aperture 500, the aperture 500 being about the same size as the cross-sectional conformation 104 of the nozzle spar 100 within the aperture 500. The endwall further includes a depression 600, the spar cap 110 being at least partially disposed within the depression 600, alternatively entirely disposed within the depression 600 (shown). The at least one surface 304 is an interior surface 602 of the depression 600 in lateral contact with and substantially laterally surrounding the spar cap 110. The interior surface 602 may surround and contact the entirety of the spar cap 110 (shown) or a portion of the spar cap 110.

Figure 8:
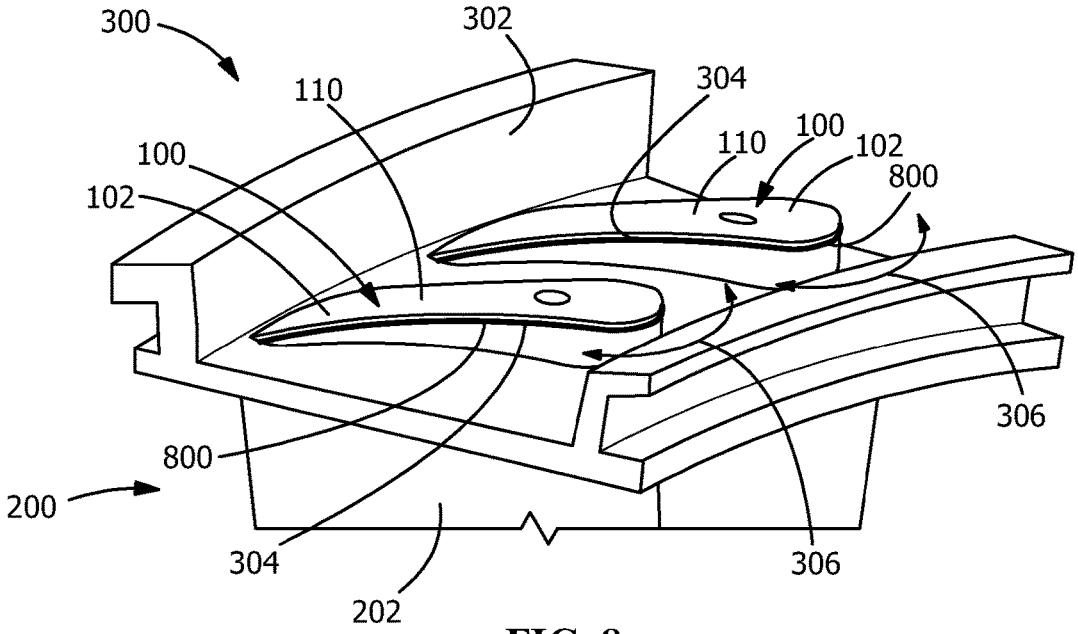
FIG. 8 is an expanded view of an endwall and spar cap of the nozzle assembly of FIG. 3 with the spar cap welded to the endwall, according to an embodiment of the present disclosure.
Figure 9:
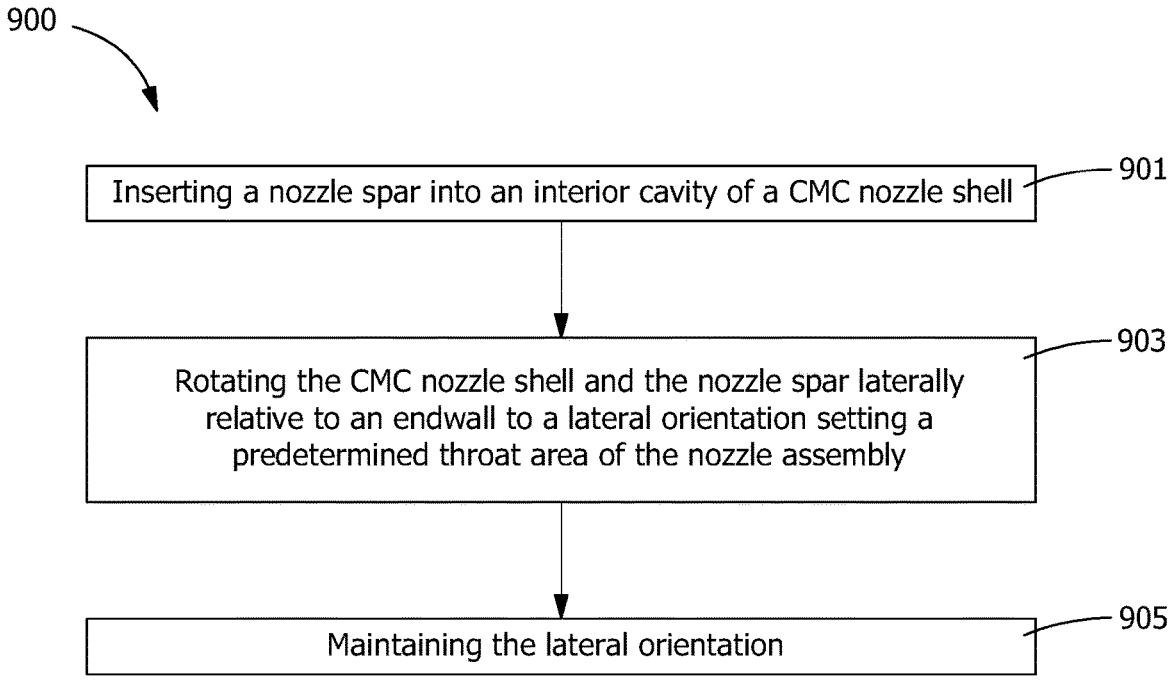
FIG. 9 is a flow chart diagram illustrating a method, according to an embodiment of the present disclosure.

Referring to FIG. 8, in one embodiment, which may be otherwise structurally similar to or identical to the embodiments depicted in FIGS. 3-7, individually or in combination, the endwall 302 maintains the lateral orientation 306 of the CMC nozzle shell 200 and the nozzle spar 100 relative to the endwall 302 by a weld 800 joining the nozzle spar 100 to the endwall 302. As used herein, the weld 800 is considered to be the at least one surface 304 in lateral contact with the spar cap 110. The position of the nozzle spar 100 relative to the endwall 302 at the weld 800 may define a butt joint, a corner joint, and edge joint, or a combination thereof. The weld 800 may be a butt weld, a fillet weld, a groove weld, a bevel weld, or a combinations thereof.

Referring to FIGS. 1-9, in one embodiment, a method 900 for forming the nozzle assembly 300 includes inserting the nozzle spar 100 into the interior cavity 204 of the CMC nozzle shell 200 (step 901), wherein inserting the nozzle spar 100 into the interior cavity 204 places the plurality of spacers 108 into contact with the CMC nozzle shell 200. The CMC nozzle shell 200 and the nozzle spar 100 are rotated laterally relative to the endwall 302 to a lateral orientation 306, setting a predetermined throat area 308 of the nozzle assembly 300 (step 903). The lateral orientation 306 is maintained (step 905), wherein maintaining the lateral orientation 306 includes placing the at least one surface 304 in lateral contact with the spar cap 110. The method 900 may further include assembling and measuring the nozzle assembly 300 to determine the lateral orientation 306 which will achieve the predetermined throat area 308, prior to maintaining the lateral orientation 306. Inserting the nozzle spar 100 into the interior cavity 204 may transfer the aerodynamic loading from the CMC nozzle shell 200 to the nozzle spar 100.

Referring to FIG. 5, rotating the CMC nozzle shell 200 and the nozzle spar 100 may include rotating the CMC nozzle shell 200 and the nozzle spar 100 through any suitable arc, including, but not limited to, a 10° arc, alternatively a 7.5° arc, alternatively a 5° arc, alternatively a 3° arc, alternatively a 1° arc.

Referring to FIGS. 3-5, in one embodiment maintaining the lateral orientation 306 includes forming the first stanchion 310 and the second stanchion 312 extending from the endwall 302, and placing the first surface 314 of the first stanchion 310 in lateral contact with the spar cap 110 and the second surface 316 of the second stanchion 312 in lateral contact with the spar cap 110. Forming the first stanchion 310 and the second stanchion 312 may include any suitable machining technique, additive manufacturing technique, or combination thereof. Suitable machining techniques including, but are not limited to, milling, grinding, electrical discharge machining, and combinations thereof. Suitable additive manufacturing techniques may include, but are not limited to, metal sintering, electron-beam melting, selective laser melting, selective laser sintering, direct metal laser sintering, direct energy deposition, electron beam freeform fabrication, and combinations thereof.

In another embodiment, maintaining the lateral orientation 306 includes forming a first alignment feature 112 including a first surface 314 and a second alignment feature 114 in the spar cap 110, the at least one surface 304 in lateral contact with the spar cap 110 including a first surface 314 in lateral contact with the first alignment feature 112 and a second surface 316 in lateral contact with the second alignment feature 114. The first alignment feature 112 and the second alignment feature 114 may be oriented relative to one another by any suitable angle 400, including, but not limited to, an angle 400 of about 60° to about 120°, alternatively about 70° to about 110°, alternatively about 80° to about 100°, alternatively about 85° to about 95°, alternatively about 90°. Forming the first alignment feature 112 and the second alignment feature 114 may include any suitable machining technique, additive manufacturing technique, or combination thereof. Suitable machining techniques including, but are not limited to, milling, grinding, electrical discharge machining, and combinations thereof. Suitable additive manufacturing techniques may include, but are not limited to, metal sintering, electron-beam melting, selective laser melting, selective laser sintering, direct metal laser sintering, direct energy deposition, electron beam freeform fabrication, and combinations thereof.

Referring to FIGS. 6 and 7, in one embodiment, maintaining the lateral orientation 306 includes forming an aperture 500 in the endwall 302, wherein the aperture 500 is about the same size as the cross-sectional conformation 104 of the nozzle spar 100 to be disposed within the aperture 500. A depression 600 is formed in the endwall 302, wherein the depression 600 is conformed to the spar cap 110 such that with the spar cap 110 at least partially disposed within the depression 600, alternatively entirely disposed within the depression 600 (shown), the at least one surface 304 is an interior surface 602 of the depression 600 in lateral contact with and substantially laterally surrounding the spar cap 110. The interior surface 602 may surround and contact the entirety of the spar cap 110 (shown) or a portion of the spar cap 110. The nozzle spar 100 is disposed in the aperture 500, and the spar cap 110 is disposed in the depression 600. The aperture 500 and the depression 600 are oriented to maintain the lateral orientation 306 of the CMC nozzle shell 200 and the nozzle spar 100. The depression may be formed by any suitable machining technique, including, but not limited to, electrical discharge machining, milling, grinding, and combinations thereof. In one embodiment, the CMC nozzle shell 200 is assembled onto the nozzle spar 100, and the CMC nozzle shell 200 on the nozzle spar 100 is measured to determine the lateral orientation 306 which will achieve the predetermined throat area 308, prior to finishing forming the aperture 500 and depression 600. Then, the aperture 500 and depression 600 are finished such that insertion of the CMC nozzle shell 200 on the nozzle spar 100 through the aperture 500 and the rotational fixing of the spar cap 100 by the depression 600 will assemble the nozzle assembly 300 having the predetermined throat area 308.

Referring to FIG. 8, in one embodiment, which may be otherwise procedurally similar to or identical to the methods disclosed above referencing FIGS. 3-7, individually or in combination, maintaining the lateral orientation 306 of the CMC nozzle shell 200 and the nozzle spar 100 relative to the endwall 302 includes welding the nozzle spar 100 to the endwall 302. Welding the nozzle spar 100 to the endwall 302 may be in addition to or in lieu of: (1) forming the first stanchion 310 and the second stanchion 312, and placing the first surface 314 of the first stanchion 310 in lateral contact with the spar cap 110 and the second surface 316 of the second stanchion 312 in lateral contact with the spar cap 110 (FIGS. 3-5); (2) forming a first alignment feature 112 and a second alignment feature 114 in the spar cap 110, the first surface 314 in lateral contact with the first alignment feature 112 and the second surface 316 in lateral contact with the second alignment feature 114 (FIGS. 3-5); (3) forming the depression 600 in the endwall 302, and at least partially disposing the spar cap 110 within the depression 600, alternatively entirely disposing the spar cap 110 within the depression 600 (FIGS. 6-7)); (4) or combinations thereof. In a further embodiment, welding the nozzle spar 100 to the endwall 302 includes welding the spar cap 110 to the endwall 302. As used herein, welding the spar cap 110 to the endwall 302 is considered to be placing the at least one surface 304 in lateral contact with the spar cap 110. Welding the spar cap 110 to the endwall 302 may include positioning the spar cap 110 and the endwall 302 to form a butt joint, a corner joint, and edge joint, or a combination thereof. Welding the spar cap 110 to the endwall 302 may include butt welding, fillet welding, groove welding, bevel welding, or a combinations thereof.

Referring to FIGS. 3-8, in one embodiment, the method 900 for forming the nozzle assembly 300 includes at least one of, alternatively at least two of, alternatively at least three of, alternatively at least four of, alternatively all of, machining the CMC nozzle shell 200 to net shape, machining the endwall 302 to net shape, machining a leading edge 318 of the nozzle assembly 300 to net shape, machining a trailing edge 320 of the nozzle assembly 300 to net shape, and machining a slash face 322 of the nozzle assembly 300 to net shape.

The method 900 may further include engaging a spacer tool to set a vertical gap 208 (see FIG. 2) between the spar cap 110 and the CMC nozzle shell 200 during throat measurement.

In one embodiment, a distribution of the plurality of spacers 108 accommodates differential thermal growth of the CMC nozzle shell 200 and the nozzle spar 100 during operation of the nozzle assembly 300 without binding between the CMC nozzle shell 200 and the nozzle spar 100.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A nozzle assembly, comprising:

a ceramic matrix composite (CMC) nozzle shell, the CMC nozzle shell including:

a CMC composition; and an interior cavity having interior dimensions;

a nozzle spar partially disposed within the interior cavity, including:

a metallic composition;

a cross-sectional conformation including cross-sectional dimensions less than the interior dimensions;

a plurality of spacers protruding from the cross-sectional conformation, the plurality of spacers contacting the CMC nozzle shell; and a spar cap; and an endwall including:

a first stanchion extending from the endwall;

a second stanchion extending from the endwall; and at least one surface in lateral contact with the spar cap, wherein:

the endwall maintains a lateral orientation of the CMC nozzle shell and the nozzle spar relative to the endwall;

the lateral orientation maintains a predetermined throat area of the nozzle assembly; and the at least one surface in lateral contact with the spar cap includes a first surface of the first stanchion in lateral contact with the spar cap and a second surface of the second stanchion in lateral contact with the spar cap, the first surface and the second surface being oriented relative to one another at about 80° to about 100°.

2. The nozzle assembly of claim 1, wherein the first surface of the first stanchion is in lateral contact with a first alignment feature of the spar cap and the second surface of the second stanchion is in lateral contact with a second alignment feature of the spar cap.

3. The nozzle assembly of claim 1, wherein the endwall is an outer diameter endwall.

4. The nozzle assembly of claim 1, wherein the endwall includes at least one aperture and the nozzle spar is partially disposed within the at least one aperture, the aperture being larger than the cross-sectional conformation of the nozzle spar within the aperture and defining a gap surrounding the nozzle spar within the aperture, the gap having sufficient size for the nozzle spar to rotate laterally within the aperture except for the presence of the at least one surface in lateral contact with the spar cap maintaining the lateral orientation.

5. The nozzle assembly of claim 3, wherein the gap includes sufficient size for the nozzle spar to rotate through a 10° arc.

6. The nozzle assembly of claim 1, wherein the metallic composition is selected from the group consisting of titanium-aluminum alloys, superalloys, nickel-based superalloys, cobalt-based superalloys, iron-based superalloys, refractory alloys, and combinations thereof.

7. The nozzle assembly of claim 1, wherein the CMC composition is selected from the group consisting of an aluminum oxide-fiber-reinforced aluminum oxide (Ox/Ox), a carbon-fiber-reinforced carbon (C/C), a carbon-fiber-reinforced silicon carbide (C/SiC), a silicon-carbide-fiber-reinforced silicon carbide (SiC/SiC), a carbon-fiber-reinforced silicon nitride ($C/Si_3N_4$), and combinations thereof.

8. The nozzle assembly of claim 1, wherein the plurality of spacers includes a conformation selected from the group consisting of vertical ribs, horizontal ribs, diagonal ribs, circular protrusions, elliptical protrusions, semi spheroidal protrusions, rectangular protrusions, square protrusions, crowned protrusions, frustoconical protrusions, annular protrusions, and combinations thereof.

9. A nozzle assembly, comprising:

a ceramic matrix composite (CMC) nozzle shell, the CMC nozzle shell including:

a CMC composition; and an interior cavity having interior dimensions;

a nozzle spar partially disposed within the interior cavity, including:

a metallic composition;

a cross-sectional conformation including cross-sectional dimensions less than the interior dimensions;

a plurality of spacers protruding from the cross-sectional conformation, the plurality of spacers contacting the CMC nozzle shell;

and a spar cap on an end of the nozzle spar, the spar cap extending across at least the cross-sectional conformation of the nozzle spar to an outer peripheral surface of the spar cap; and an endwall including at least one surface in lateral contact with the spar cap, the endwall maintaining a lateral orientation of the CMC nozzle shell and the nozzle spar relative to the endwall, the lateral orientation maintaining a predetermined throat area of the nozzle assembly, wherein the endwall includes at least one aperture and the nozzle spar is partially disposed within the at least one aperture, the aperture being about the same size as the cross-sectional conformation of the nozzle spar within the aperture, the endwall further including a depression distal across the endwall from the CMC nozzle shell, the depression being defined by a wall projecting from the endwall in a direction oriented away from the nozzle shell, the spar cap being at least partially disposed within the wall defining the depression, the at least one surface being an interior surface of the wall defining the depression in lateral contact with and laterally surrounding an entire perimeter of the spar cap corresponding with the lateral orientation of the CMC nozzle shell, wherein the spar cap is connected to the endwall via a weld between the wall and the outer peripheral surface of the spar cap.

10. The nozzle assembly of claim 9, wherein the endwall is an outer diameter endwall.

11. The nozzle assembly of claim 9, wherein the spar cap is entirely disposed within the depression.

* * * * *